United States Patent [19]

Cramer

[11] Patent Number: 5,011,060

[45] Date of Patent: Apr. 30, 1991

[54] ROLL FOR SPREADING AND GUIDING A FABRIC WEB

[75] Inventor: Hans Cramer, Aachen, Fed. Rep. of Germany

[73] Assignee: H. Krantz GmbH & Co., Aachen, Fed. Rep. of Germany

[21] Appl. No.: 432,467

[22] Filed: Nov. 7, 1989

[30] Foreign Application Priority Data

Nov. 23, 1988 [DE] Fed. Rep. of Germany ..... 3839473

[51] Int. Cl.[5] ..... B23Q 16/00; B06C 3/06; B21B 1/22

[52] U.S. Cl. ..... 226/15; 226/190; 26/105; 29/121.4; 198/840

[58] Field of Search ..... 226/190, 194, 195, 15, 226/17; 29/121.4, 124; 198/840, 870; 26/87, 99, 105

[56] References Cited

U.S. PATENT DOCUMENTS

| | | | |
|---|---|---|---|
| 1,474,346 | 11/1923 | Campbell | 29/124 X |
| 2,176,835 | 10/1939 | Cumfer | 29/121.4 X |
| 2,539,157 | 4/1952 | Lorig | 198/840 X |
| 3,838,481 | 10/1974 | Kuroda | 226/17 X |
| 3,958,309 | 5/1976 | Conti | 26/105 |
| 4,021,894 | 5/1977 | Poterala et al. | 29/121.4 X |
| 4,552,295 | 11/1985 | Smith et al. | 226/190 X |
| 4,567,492 | 1/1986 | Skafuensledt et al. | 226/17 X |
| 4,656,702 | 4/1987 | Tsuchida | 26/99 X |

*Primary Examiner*—Daniel P. Stodola
*Assistant Examiner*—Paul T. Bowen
*Attorney, Agent, or Firm*—Mark T. Basseches

[57] ABSTRACT

A combined fabric stretching and straightening apparatus is comprised of a pair of cylinders having helical configurations on their periphery the cylinders being mounted for rotation on a shaft adapted to be driven in a direction opposite the direction of feed of a fabric web. The cylinders may rotate relative to each other and the shaft or may be coupled to rotate with the shaft by clutches interposed between the cylinders and shaft. Sensors are optionally provided for energizing one or the other clutch so as to center the fabric as it is fed.

3 Claims, 1 Drawing Sheet

ROLL FOR SPREADING AND GUIDING A FABRIC WEB

BACKGROUND AND FIELD OF THE INVENTION

This invention relates to a roll for spreading and guiding a fabric web being processed.

THE PRIOR ART

It is known to provide a shaft-supported roll cylinder with radially protruding, bead-like spirals or helices as a means for spreading a fabric web engaging the cylinder The helices extend from the center of the roll width in mutually opposite direction toward the roll ends, diverging in the direction of movement of the fabric web.

Such rolls permit exerting a widthwise spreading effect on the fabric web due to the frictional action of the bead-like spirals diverging in transport direction of the fabric web, this spreading action being especially effective if the roll is driven in a direction of rotation opposite to the transport direction of the fabric web.

To be able to use the known rolls for fabric webs of different widths, the roll width is matched to the maximum anticipated fabric width and as a rule exceeds it by an allowance that takes skewing of the fabric web into account. Skewing of the fabric web results whenever the longitudinal center line of the fabric web does not coincide with the center of the roll width. As soon as a deviation occurs, the skewing pull on the fabric web becomes greater as the latter comes in contact with that roll half over which the larger width section already runs.

For continuous correction of the widthwise run of a fabric web it is customary, therefore, to use in addition to the spreader cylinders a straightening roll with which correction skewing of a fabric web can be brought about by turning the center axis of the straightening roll at an angle to a direction perpendicular to the transport direction.

The known systems for guiding and spreading a fabric web therefore often require, the additional use of a straightening roll and such rolls are relatively costly.

SUMMARY OF THE INVENTION

It is an object of the invention to provide a roll apparatus for guiding a fabric web with which the fabric web can be guided in a widthwise stretched state as well as being held with its longitudinal center axis in the center of the roll width Moreover, in the event of skewing, the web may be brought back to the center continuously, it being possible to use the roll selectively only as a widthwise stretching roll or only as a straightening roll.

In accordance with the invention, a roll apparatus comprised of two cylinders having diverging helices are mounted on a shaft. The shaft may be driven in a direction opposite the feed direction of the web. The roll segments are rotatable relative to each other and the shaft. The rolls may be coupled to the shaft by clutches Where the rolls are uncoupled from the shaft, the device operates as a conventional stretching device If, however, one or the other roll segment is coupled with the shaft driven in a direction opposite to the transport direction of the fabric web, a very efficient transverse displacement of the fabric web toward the roll center can thereby be brought about.

According to a development of the invention, each roll segment can be coupled with the shaft via an electromagnetic clutch, the electromagnetic clutch being switchable through a position sensing transducer which senses the edge course of the fabric web.

By this design, the roll according to the invention can be transformed spontaneously, depending on the particular width course of the fabric web, from a widthwise stretching roll into a straightening roll, so that the roll can selectively assume one or the other or both functions simultaneously.

If over a protracted period only one or the other function is expected of the roll, it is especially appropriate, according to a further development of the invention, to design the position transducers and the electromagnetic clutches for being switched on and off independently of each other.

The new roll can be used also so as to achieve a normal spreading effect when both roll segments ar coupled with e the shaft. If then the fabric web runs askew toward one roll side, the coupling of the respective roll segment can be temporarily stopped. Alternatively the possibility exists to drive both roll segments by the fabric web only, with the clutches disengaged. If then the fabric web skews toward one fabric web side, the clutch of the respective roll segment can be engaged temporarily, so that the roll segment rotates counter to the running direction of the fabric web or in running direction of the fabric web at a circumferential speed greater than the running speed of the fabric web, whereby a straightening effect is obtained.

BRIEF DESCRIPTION OF THE DRAWINGS

An example of realization of the roll according to the invention is illustrated in the drawing.

Figure 1:
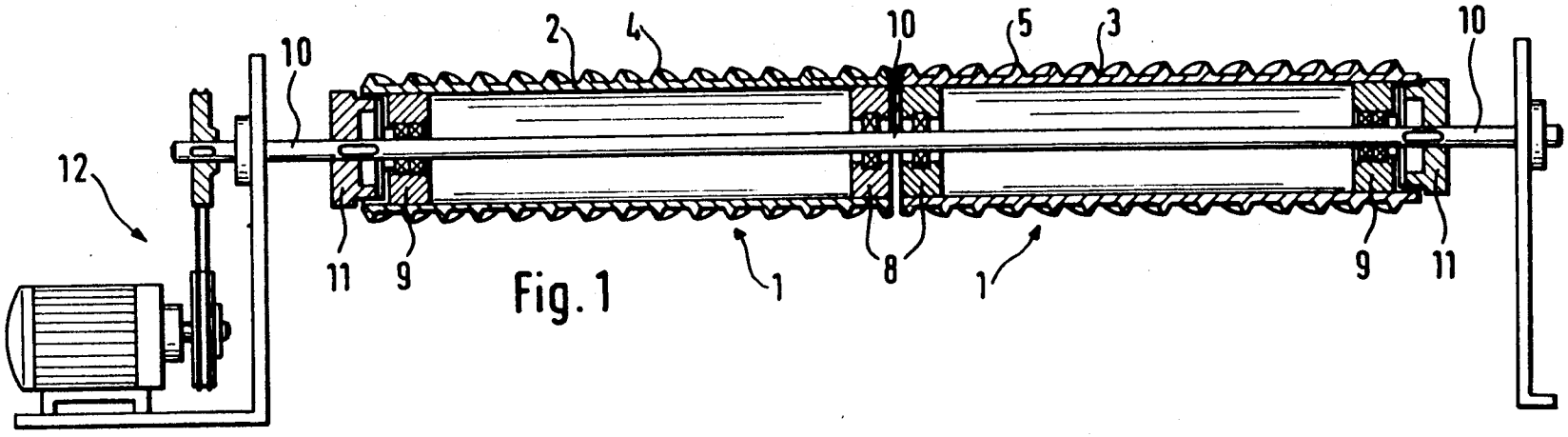
FIG. 1 shows a longitudinal section through the roll apparatus.
Figure 2:
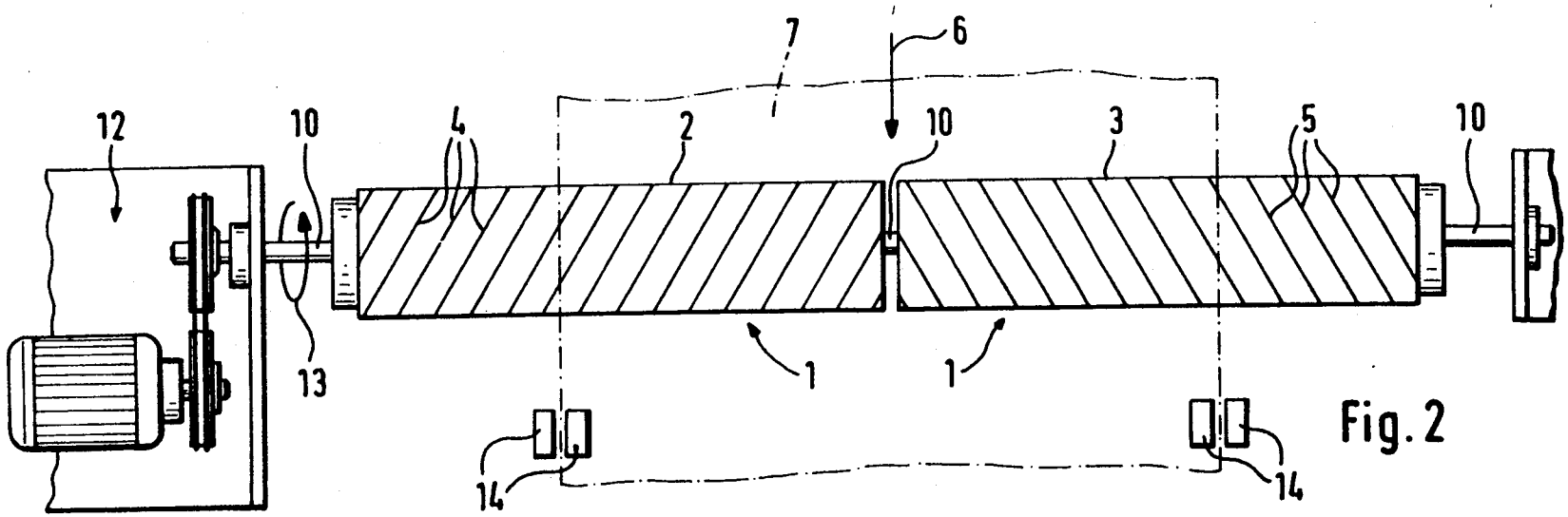
FIG. 2, a top plan view of the apparatus.

The apparatus consists of a roll assembly 1, composed of two roll segments 2 and 3 of equal width. On each roll segment 2,3, radially protruding, bead-like spirals or helices 4,5 are provided, which in FIG. 2 are indicated only schematically, while FIG. 1 clearly show the resulting roll contour. The helices 4 and 5 extend from the center of the roll toward the ends in opposite pitch directions and diverge with respect to arrow 6 which indicates the transport direction of a fabric web 7.

Each of the roll segments 2,3 include two bearing disks 8 and 9, by which the roll segments 2,3 are mounted freely rotatable on a continuous shaft 10. Via a magnetic clutch 11 the bearing disks 9 and hence the roll segments 2,3 can be coupled selectively and independently of each other with the shaft 10 which is drivable by a drive 12 in the direction of an arrow 13 counter to the transport direction of the fabric web 7.

With sensors 14 scanning the edges of the fabric web 7, skewing of the fabric web 7 can be recorded and optionally the clutch 11 of roll segment 2 or 3 can be switched, so that there occurs a drive of the respective roll segment 2 or 3 counter to the running direction of the fabric web 7 and thereby its return toward the roll center is initiated.

From the foregoing, it will be appreciated that there is provided, in accordance with the invention, an apparatus which can both spread and center a fed fabric web. The sensors, which may be of any known type, can energize clutches to effect either a centering or a spreading action or both.

Numerous variations in details of construction ma occur to skilled workers in the art familiarized with the instant disclosure, and accordingly the invention is to be broadly construed when the scope of the appended claims.

I claim:

1. An apparatus for spreading and guiding a fabric web positively advanced in a selected direction comprising a shaft, first and second cylinders coaxially mounted on said shaft for rotation relative to said shaft and to each other, said cylinders having end portions said end portions of said cylinders being disposed in proximate spaced relation adjacent the center of said shaft, said cylinders including helical configurations on the periphery thereof positioned to support said web, the pitches of said configurations being arrayed in opposite directions, means for rotating said shaft in a direction opposite said selected direction, and first and second clutch means interposed between said shaft and said first and second cylinders respectively for selectively coupling said cylinders to said shaft for rotation therewith for shifting said fabric web laterally of said shaft in a selected direction in accordance with which of said clutch means is energized, said web being spread in a widthwise direction by said cylinders when said cylinders are decoupled from said shaft.

2. Apparatus in accordance with claim 1 wherein said clutch means are electromagnetically operated.

3. Apparatus in accordance with claim 2 and including sensor means for sensing the location of the edge portions of said web, and for selectively energizing said first and second clutch means in accordance with the location of said edge portions of said web.

* * * * *